US007497098B1

(12) United States Patent
Imboden

(10) Patent No.: US 7,497,098 B1
(45) Date of Patent: Mar. 3, 2009

(54) RUN PREVENTION METHODS AND GARMENTS

(75) Inventor: Walter H. Imboden, Burlington, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 160 days.

(21) Appl. No.: 11/219,566

(22) Filed: Sep. 2, 2005

Related U.S. Application Data

(60) Provisional application No. 60/606,775, filed on Sep. 2, 2004.

(51) Int. Cl.
*D04B 1/06* (2006.01)

(52) U.S. Cl. ..... 66/178 R; 66/169 A

(58) Field of Classification Search ..... 66/175, 66/176, 177, 178 R, 169 A
See application file for complete search history.

(56) References Cited

U.S. PATENT DOCUMENTS 2,049,994 A * 8/1936 Carlson ..... 66/169 R
2,060,882 A * 11/1936 Lochhead ..... 66/169 R
2,421,357 A * 5/1947 Saftlas ..... 66/170
2,706,389 A * 4/1955 Garrou et al. ..... 66/177
3,085,410 A * 4/1963 Loizillon ..... 66/185
3,362,029 A * 1/1968 Comerma ..... 2/240
3,375,530 A * 4/1968 Matthews et al. ..... 2/402
3,670,529 A * 6/1972 Fregeolle ..... 66/177
3,757,354 A * 9/1973 Moody ..... 2/409
3,834,192 A * 9/1974 Giraud ..... 66/147
3,985,004 A 10/1976 Johnson et al.
4,043,156 A 8/1977 Pernick
4,527,403 A 7/1985 Fullbright et al.
4,663,946 A 5/1987 Wright
4,722,202 A 2/1988 Imboden
4,736,468 A 4/1988 Efird et al.
5,181,278 A 1/1993 Peleg et al.
5,850,745 A 12/1998 Albright
5,855,123 A 1/1999 Albright
7,155,940 B1 * 1/2007 Imboden et al. ..... 66/8

* cited by examiner

*Primary Examiner*—Danny Worrell
(74) *Attorney, Agent, or Firm*—Kilpatrick Stockton LLP

(57) ABSTRACT

A garment run prevention method includes cutting an opening, for example for a leg, in a portion of a knitted garment approximately parallel to the wales across a minimum number of wales to prevent runs in the direction of knitting. Another aspect of such a method includes knitting a garment from back to front and placing run-prevention stitches, such as float stitches or tuck stitches, in areas where cutting a front leg opening cuts across wales of the garment to prevent runs in the direction of knitting.

23 Claims, 4 Drawing Sheets

RUN PREVENTION METHODS AND GARMENTS

CROSS-REFERENCE TO RELATED APPLICATIONS

This application is a non-provisional application of, and claims priority to, Applicant's co-pending U.S. Provisional Patent Application No. 60/606,775, filed Sep. 2, 2004, which provisional application is incorporated herein in-full by reference.

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

FIELD OF THE INVENTION

The present invention relates to methods for preventing runs in garments and garments made by such methods. Embodiments of the present invention are particularly advantageous for preventing runs in fine denier underwear.

BACKGROUND OF THE INVENTION

The present invention relates to the fabrication of garments such as underwear garments, including panties and briefs, bathing suits, and any number of garments covering the lower part of a wearer's trunk from the waist downward, and having leg openings on opposite sides of a crotch portion.

Conventional methods for manufacturing underwear garments are disclosed, for example, in U.S. Pat. Nos. 1,985,965; 3,375,530; 4,031,568; 4,173,976; 4,615,051; 4,624,115; and 4,736,468.

As an example, U.S. Pat. No. 4,736,468 discloses knitting three fabric tubes, two of such tubes being somewhat similar in diameter and length and the third tube being substantially smaller in length and diameter than the other two tubes. Each of the two larger tubes may include an elastic band section at one end thereof. Each of the two larger tubes is slit lengthwise to form two generally rectangular panels. The small tube is slit lengthwise along one side, thereby forming a crotch panel. The crotch panel is then secured to the two larger panels, and the two larger panels are positioned in superposed relation and then secured together, such as by sewing a seam, along selected overlying edge portions. Prior to securing the two larger panels to each other, selected portions may be severed therefrom to define tapered or arcuate edges, and leg opening elastic may be applied thereto. Fabric in the areas where leg openings are cut is susceptible to runs.

Another conventional method of manufacturing an underwear garment comprises initially knitting a tubular panty blank on a circular knitting machine, slitting the tubular blank lengthwise, cutting away an arcuate segment of excess fabric from the areas which will form leg openings, folding the blank lengthwise to bring together the raw edges formed by slitting, and then sewing the raw edges together at opposite sides to complete the underwear garment. The blank, as it comes off the knitting machine, can be an hourglass configuration resulting from the knitting of a lengthwise region, or crotch, approximately midway between the opposite ends of the blank such that this region has a lesser diameter than the end regions of the blank. Such a mid-portion crotch having a lessened diameter can be created using a mock rib construction. Representative patents disclosing this methodology are U.S. Pat. Nos. 3,985,004; 4,048,819; and 4,663,946. A conventional means of elasticating the leg openings is to sew a narrow width elastic band along the perimeter of each leg opening to provide a finished and elasticated edge.

Such a one-piece garment requires that half the tubular blank be produced with the knitting of the garment proceeding in the "wrong direction". That is, opposing front and back portions of such a one-piece garment are folded over onto each other and the diameter increases from the narrowest point at the crotch area to the widest point at the waistband. As a consequence, the knitted loops are oriented oppositely, and thus proceed in the "wrong direction" with respect to the direction of knitting, in half of the finished product. If knitting is in the direction from front to back, the knitted loops in the back portion would be in the "wrong direction" when the front and back are folded onto each other. Likewise, if knitting is in the direction from back to front, the knitted loops in the front portion would be in the "wrong direction" when the front and back are folded onto each other. Knitted stitches in the "wrong," or reverse, position with respect to the direction of knitting are susceptible to runs.

In other conventional approaches to underwear garment manufacture, including those in which garments comprise separate portions such as a front panel, a back panel, and a crotch panel, knitting may occur in one direction in a finished garment. That is, typically the front portion is knit first, followed by knitting the crotch portion, and finally the back portion is knit. The direction of knitting in conventional underwear garment manufacture is from front to back. Knitting from front to back does not allow use of techniques to reduce or prevent runs in the front portion (in the direction opposite the knitting direction) of a finished panty garment.

In the so-called "backward" or "reverse" procedure used in knitting, there is no practical "run guard" or "run-proof" stitch available to prevent a run in the direction of knitting from starting in the area where openings are cut across wales, such as in leg cut-outs, particularly in the front portion, of an underwear garment.

Thus, there is a need to provide a method for manufacturing garments that will reduce and/or prevent runs in garments. There is a need for a method for manufacturing that will reduce and/or prevent runs in underwear garments, particularly in the front portion of the garments.

SUMMARY OF THE INVENTION

The present invention provides a method for preventing runs in a garment and garments made by such a method. Embodiments of such a method are particularly useful for preventing runs from starting in areas adjacent leg cut-outs in an underwear garment that is knit from back to front. In an illustrative embodiment, a method for preventing runs in a garment includes knitting a garment blank in a direction from an upstream beginning to a downstream ending. A location can be marked for making a cut-out across wales. Run prevention stitches are knit in predetermined courses downstream from the cut-out location. When the cut-out is made along the marked location, runs are prevented downstream from the cut-out in the direction of knitting. Such a method may further include marking a location for making another cut-out upstream from the cut-out. This location is marked along an angle substantially parallel to the wales. When the upstream cut-out is made along its respective marked location, runs are prevented downstream from the upstream cut-out.

In an embodiment, a method includes first knitting the back portion of a garment followed by knitting the front portion of the garment, that is, knitting from the back to the front. Markings for cut-outs can be placed at pre-determined locations in the garment blank when it is knitted. Such markings can be designated with sewing marks. Portions of the back and front portions are cut away along the sewing marks to provide openings, for example, leg openings. The back portion cut-outs are made along an angle substantially parallel to the wales such that a minimum number of wales are cut across, or no wales are cut across. In this manner, runs originating from the cut-out in the back portion are effectively prevented from extending to the front portion of the garment.

In another aspect of the present invention, a garment blank is knit in one direction, and "run-prevention" stitches are placed in pre-determined courses of the knitted garment blank along areas where cut-outs are to be cut across wales. "Run-prevention" stitches include, for example, float stitches and tuck stitches. In an embodiment of the present invention in which the direction of knitting is from back to front, run-prevention stitches can be placed in particular courses, for example in areas along curved sew lines downstream from and/or adjacent where cut-outs are to be made across wales in the front portion. Accordingly, run-prevention stitches placed downstream of the front portion cut-out, that is, in the front portion of the garment, prevent runs in the direction of knitting up the front of the finished garment.

In an embodiment of the present invention, a method for preventing runs in a knitted garment may include knitting a garment in one direction (for example, from front to back or from back to front), placing run-prevention stitches in courses at locations adjacent areas where cut-outs are to be cut across wales, and making those cut-outs, such as for a leg or arm opening, across a minimum number of wales, or across no wales. The combination of cutting across a minimum number of wales for cut-outs substantially parallel to the wales and the placement of run-prevention stitches downstream from the areas for cut-outs across wales effectively prevents runs in the direction of knitting at both cut-out areas.

The present invention includes embodiments of garments made by the methods described herein. For example, in one embodiment, a garment can be knit in a direction from a back portion to a front portion. Arcuate sewing marks for cut-outs can be placed at pre-determined locations in the garment blank when it is knitted. Portions of the back and front portions are cut away along the sewing marks to provide openings, such as leg openings. The back portion cut-outs are made along an angle substantially parallel to the wales such that a minimum number of wales are cut across, or no wales are cut across. In this manner, runs from the back to the front of the garment are effectively prevented.

In another embodiment of a garment according to the present invention, a garment blank knit in one direction includes "run-prevention" stitches, such as float or tuck stitches, placed in desired courses of the blank along areas where cut-outs are to be cut across wales. In particular, in an embodiment in which the direction of knitting is from back to front, run-prevention stitches can be placed in areas along curved sew lines downstream from where cut-outs are to be made in the front portion. Such placement of run-prevention stitches in the front portion of the garment prevents runs in the direction of knitting up the front of the finished garment.

Other embodiments of a garment of the present invention include a garment knit in one direction (from front to back or from back to front), an opening cut in a portion of the garment, such as a leg or arm opening, across a minimum number of wales, or across no wales, and run-prevention stitches knit in courses at locations downstream from areas where cut-outs are to be cut across wales. In such a garment, the combination of cutting across a minimum number of wales for cut-outs substantially parallel to the wales and the placement of run-prevention stitches downstream from the areas for cut-outs across wales provides a garment in which runs are prevented in the direction of knitting at both cut-out areas.

Features of a run prevention method and garments made according to such a method of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A run prevention method and garment of the present invention provide numerous advantages over prior approaches to reducing the potential for runs in garments. For example, the present invention advantageously provides a method for preventing, rather than only reducing the risk of, runs in garments, such as fine denier panties.

Another advantage is that the present invention provides a method for preventing runs in underwear garments made on conventional hosiery knitting machines. As such, effective means for preventing runs can be employed while making underwear garments on hosiery machines that may otherwise be idle.

Another advantage is that the present invention provides a method for preventing runs in underwear garments while making such garments on conventional hosiery knitting machines rather than making underwear garments on full-body size machines and wasting significantly more fabric by cutting away undesired portions.

As will be realized by those of skill in the art, many different embodiments of run prevention methods and garments made by such methods according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

Figure 1:
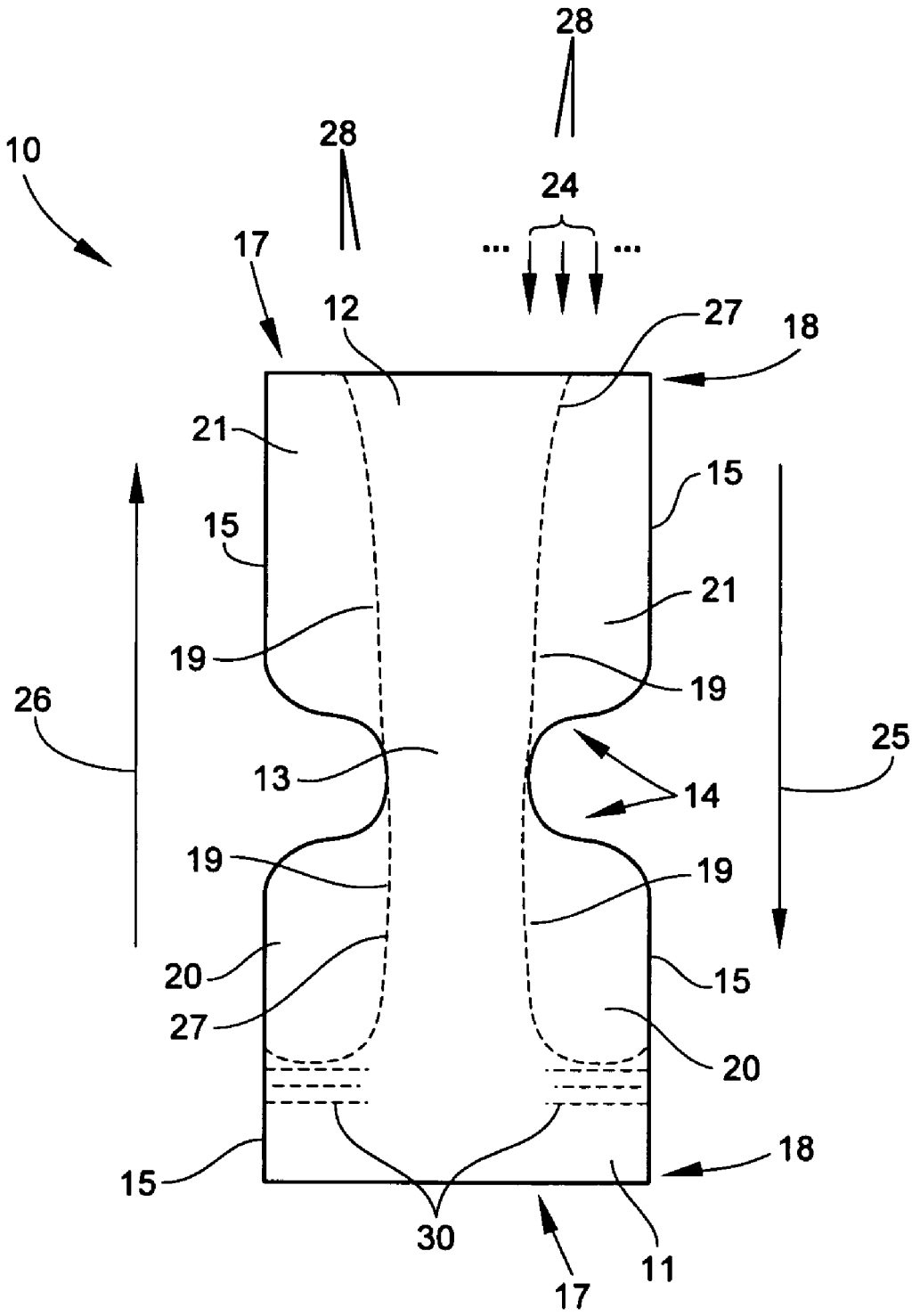
FIG. 1 is a diagrammatic view of a one-piece underwear garment blank in an embodiment of the present invention.

Embodiments of the present invention include methods for preventing runs in garments, and in particular lower body garments, such as underwear garments, and garments made by such methods. As used herein, an "underwear garment"

includes panties, briefs, footless pantyhose, or any garment made for wearing around a wearer's waist, lower torso or abdomen, and legs. In an embodiment of the present invention, as shown in FIG. 1, an underwear garment blank 10 includes a front portion 1, or panel, for covering the lower abdomen, a back portion 12, or panel, for covering the buttocks, and a crotch portion 13, or panel, interconnecting the front and back panels 11, 12, respectively, at the bottom 14 thereof. In a finished underwear garment, the front and back panels 11, 12, respectively, are connected by side seams 15. An elastic waistband, or welt 18, can extend around the top portion 17 of the garment 10, and elastic bands can be attached to edge portions 19 of the front, rear, and crotch panels 11, 12, 13, respectively, defining the leg openings.

In manufacture of many types of underwear garments, the area 20 cut out for legs in the front portion 11 of the underwear garment blank 10 is greater than the area 21 cut out for legs in the back portion 12 of the blank 10. Such a design leaves more fabric in the back portion 12 than in the front portion 11 for greater coverage of the buttocks region. This design is due to the human anatomy in the front lower torso and buttocks regions, particularly the female anatomy in these regions, and because of underwear fashions. When the areas 20 for the leg cut-outs are made in the front portion 11 of an underwear garment 10, for example, either manually by an operator or in an automated process, cuts are made generally across wales 24. As a consequence, cutting across wales 24 can increase the risk of producing loose yarn ends in that area, which can then create a "run" in the finished garment. Thus, areas adjacent leg openings produced by cutting across wales 24 are vulnerable to "runs." A "run" is defined as a length of cut, torn, or unraveled stitches in a knitted fabric.

After front and back portion leg openings 20, 21, respectively, are cut out, a welt 18, can be sewn around the cut edges 19 of the leg openings 20, 21. The welt 18 may include an elastic component, such as, for example, spandex yarn or an elastic band. When the welt 18 is sewn across wales 24 around the leg openings 20, 21, particularly in the front portion leg openings 20, there is a risk that loose yarn ends can "run" during the sewing process. Embodiments of the present invention provide means and methods for reducing and preventing such "runs" in knitted garments.

As used herein, the terms "upstream" and "downstream" refer to location of a portion of a garment, a direction of knitting, and/or movement of runs in a garment. As such, the terms "upstream" and "downstream" are relative one to the other or to other structures in a garment and/or direction of knitting. For example, one cut-out may be upstream from another cut-out, and runs can be prevented "downstream" from a particular cut-out.

In one aspect of the present invention, as shown in FIG. 1, an embodiment can include knitting an underwear garment blank 10 in a direction 25 from the back 12 to the front 11. Such an embodiment includes first knitting the back portion 12 of the garment 10 followed by knitting the front portion 11 of the garment 10, as opposed to the conventional front-to-back direction 26 of knitting in a lower body garment. Sewing marks 27 can be knit into the front and back portions 11, 12, respectively, of the garment 10 for indicating the locations for cutting out leg openings 20, 21 (and for sewing welts 18 along edges 19 of the cut-outs 20, 21). Sewing marks can be incorporated into knitting by programming in a knitting machine stitch and/or yarn changes at pre-determined locations. In the underwear garment blank 10 shown in FIG. 1, less fabric is cut from the back portion 12 than the front portion 11 for leg openings. The angle 28 at which the leg openings 21 in the back portion 12 are cut is approximately parallel to the wales 24. As a consequence, fewer wales 24, or substantially no wales 24, are cut across when making leg openings 21 in the back portion 12, thereby reducing, or preventing, the possibility of runs in the back portion 12 of the underwear garment 10. In addition, cutting across a minimum number of wales 24 provides a stronger seam along the edge 19 of the leg cut-out 21.

In another aspect of the present invention, run-prevention stitches 30 are placed in pre-determined courses 40 of the knitted garment 10. For example, in the embodiment shown in FIG. 1, run-prevention stitches 30 are knit adjacent and downstream to the sewing marks 25 where the front leg openings 21 are to be cut out. Run-prevention stitches 30, such as float stitches and tuck stitches, can be used to stop runs in the direction of knitting 25, but not in the direction 26 opposite the knitting direction. Accordingly, run-prevention stitches 30 placed downstream of the front leg opening cut-out areas 20 can prevent runs in the direction of knitting 25, that is, in the front portion 11 of the underwear garment 10.

Embodiments of the present invention include a method for preventing runs in the knitted garment 10 that may comprise knitting a garment in one direction (for example, from front to back (25) or from back to front (26)), cutting an opening in one portion (back 12 or front 11) of the garment blank 10, such as a leg or arm opening, across a minimum number of wales 24, or across no wales 24. Such an embodiment further includes placing run-prevention stitches 30 in courses 40 at locations downstream in the direction 25 of knitting from an area for cutting the front leg opening cut-out 20. The combination of cutting across a minimum number of wales 24, or across no wales 24, at the upstream opening 21 and the placement of run-prevention stitches downstream from the front leg opening cut-out 20 prevents runs in the direction 25 of knitting at both openings 20, 21.

Figure 3:
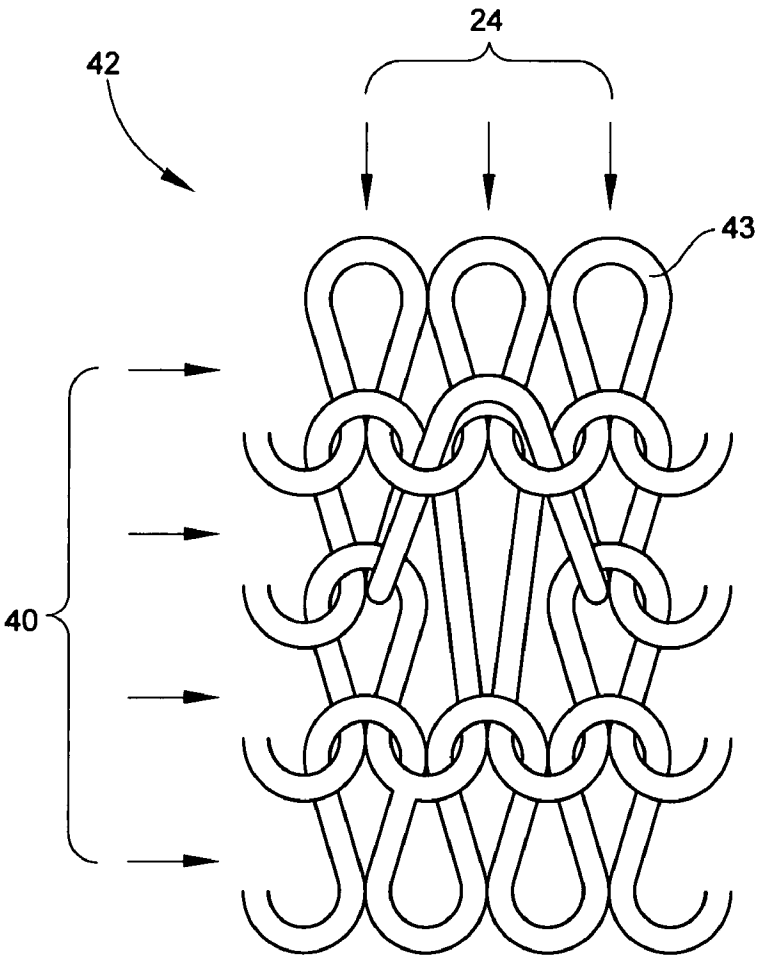
FIG. 3 is a diagrammatic view of a tuck stitch useful in an embodiment of the present invention.
Figure 2:
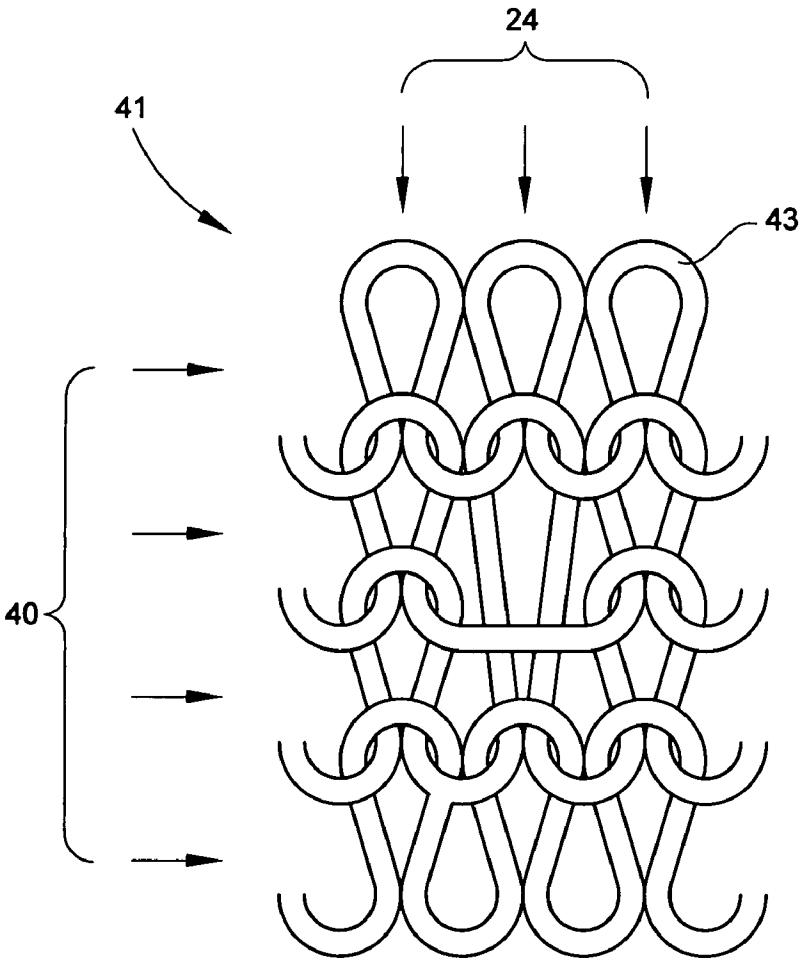
FIG. 2 is a diagrammatic view of a float stitch useful in an embodiment of the present invention.

Run-prevention stitches 30 can include, for example, float stitches 41 and tuck stitches 42, as shown in FIGS. 2 and 3, respectively. A "float stitch" 41, or "miss" stitch, is defined as a stitch formed when a knitting needle holds an old loop (loop 43 depicts a loop generally) and does not receive new yarn, thereby connecting two loops of the same course 40 that are not in adjacent wales 24. An example of a float stitch 41 useful in embodiments of the present invention is a single end float stitch 41. A float stitch 41 can stop a run in a wale 24 in which it is knit and in adjacent wales 24. Accordingly, effective run prevention downstream of a cut-out 21 cut across wales 24 can be accomplished by a float stitch 41 in intermittent wales 24, for example, in alternating wales 24. A "tuck stitch" 42 is defined as a knitting stitch that produces tuck or openwork effects by having certain needles hold more than one stitch at a time. A tuck stitch 42 can be produced by raising the latch of a knitting needle far enough to receive a new yarn below the hook but without the old yarn loop(s) sliding below the latch of a circular knitting machine, such that when the needle recedes, both new and old loops are retained. In embodiments of the present invention, float stitches 41 and tuck stitches 42 can prevent runs in the direction of knitting 25.

Figure 4:
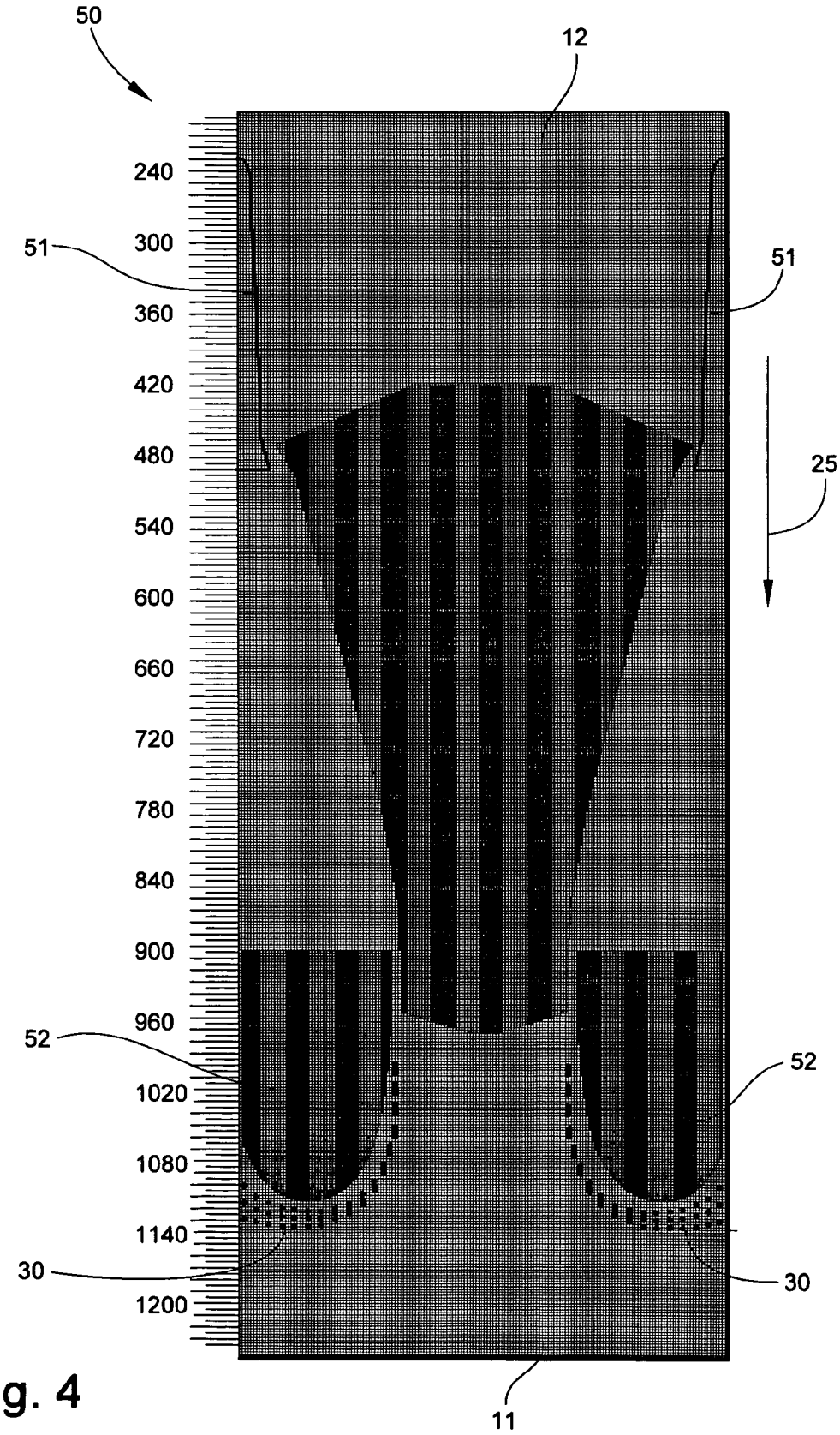
FIG. 4 is a diagrammatic view of a knit pattern for an underwear garment showing placement of run prevention stitches adjacent front leg cut-out areas in the direction of knitting in an embodiment of the present invention.

FIG. 4 illustrates a knit pattern 50 for an underwear garment in an embodiment of the present invention. An underwear garment knit according to this pattern 50 is knit from back 12 to front 11. The back leg cut-out lines 51 (which represent the back leg opening sew lines) are substantially parallel to the wales 24 such that a minimum number of wales 24 are cut across when the back leg openings 21 are cut. As a result, loose ends and runs are prevented along the back leg openings 21. In automated underwear manufacturing operations, cutting leg openings 20, 21 and sewing seams 15 and/or bands around the edges 19 of the leg openings 20, 21 is a combined and nearly simultaneous step. The knitting pattern 50 in FIG. 4 shows that run-prevention stitches 30 are knit downstream and adjacent to the sewing marks, or front leg opening cut-out lines 52, where the front leg openings 20 are to be cut out. Run-prevention stitches 30 placed downstream to front leg opening cut-out lines 52 prevent runs, in the direction of knitting 25, up the front 11 of the underwear garment 10.

In other embodiments, the direction of knitting 26 can be from front 11 to back 12. In such embodiments, front cut-out/sew lines 27 can be approximately parallel to the wales 24 such that a minimum number of wales 24 are cut across and runs are thereby prevented in the front portion 11 of the garment 10. In the area of the back leg openings 21, run-prevention stitches 30 can be knit downstream the opening areas 21 so that runs are prevented in the back portion 12 of the garment 10. In other embodiments, cut-out/sew lines 27 in the front 11 of the garment 10 can be approximately parallel to the wales 24 such that a minimum number of wales 24 are cut across and runs are prevented downstream from those cut-outs 20. In an embodiment, a garment 10 can include both run prevention stitches 30 downstream of front portion cut-outs 20 cut across wales 24, and back portion cut-outs 21 cut substantially parallel to the wales 24, thereby preventing runs in both front and back portions 11, 12, respectively, of the garment 10.

Figure 5:
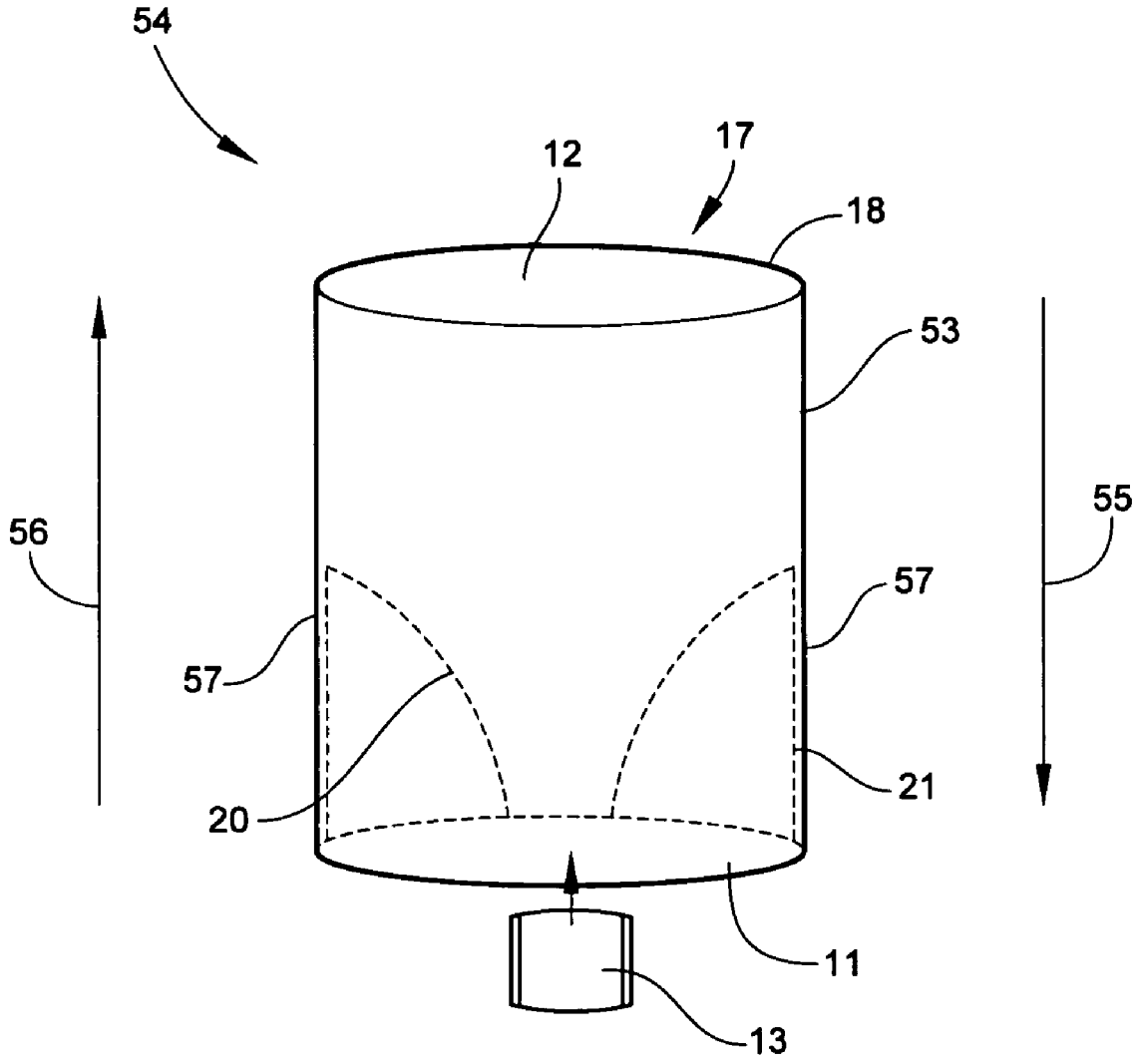
FIG. 5 is a diagrammatic view of front panel, back panel, and crotch panel of an underwear garment including run prevention elements in an embodiment of the present invention.

As shown in FIG. 5, the present invention includes an embodiment of a method comprising knitting a front portion 11 of an underwear garment blank 54 separately from a back portion 12 of an underwear garment blank 10. The front and back portion blanks 11, 12, respectively, are then sewn together to form seams 57 along each longitudinal side 53 to form a tubular blank 54. On one end of the tubular blank 54, a welt 18 can be formed to provide a waist portion. On the end of the blank 54 opposite the waist portion, a separately formed crotch portion 13 can be sewn in between the front and back portions 11, 12, respectively. The angle at which the leg opening 21 in the back portion 12 is cut is approximately parallel to the wales 24. As a consequence, fewer wales 24 are cut across when making leg openings 21 in the back portion 12, thereby reducing, or preventing, the possibility of runs in the direction of knitting 55 in the back portion 12 of the underwear garment 54. In embodiments in which the front portion 11 is knit from the bottom to the top toward the waist, or welt 18, run-prevention stitches 30 can be knit downstream and adjacent to the sewing marks where the front leg openings 20 are to be cut out, which prevent runs in the direction of knitting 56 in the front portion 11 of the underwear garment 54.

In embodiments of the present invention, the garment blank having a "starting" end and a "stopping" end can be knit in one direction or, alternatively, in the opposite direction. One such garment is a footless pantyhose garment (not shown). A footless pantyhose garment can be knit from the bottom ("starting" end) to the top ("stopping" end) of the garment. Run-prevention stitches 30 can be placed at pre-determined locations to prevent runs in the direction of knitting, that is, in the "bottom-up" direction in the garment. In such embodiments, run-prevention stitches 30 placed in the "bottom-up" direction of knitting can prevent runs from going "up" the garment toward the panty and waist portion. In other embodiments in which the direction of knitting is in the "top-down" direction, run-prevention stitches 30 can be placed at pre-determined locations downstream from leg opening cut-outs in the direction of knitting to prevent runs from going "down" the garment toward the leg portions of the pantyhose.

In the present invention, embodiments of a method for preventing runs can be particularly useful in fine denier, or sheer, garments. In other embodiments, such a method can be effectively utilized to prevent runs in garments employing heavier denier yarns and fabrics, for example, cotton. For example, in a cotton brief, knitting may be performed from the waist in the back to the waist in the front. Leg openings 21 may then be cut in the back 12 of the brief at an angle 28 approximately parallel to the wales 24 to reduce, or eliminate, the number of wales 24 being cut across. Such an embodiment may also include placing run prevention stitches 30 at pre-determined locations, for example, downstream from the leg opening cut-out areas 20 in the front 11 of the brief, to prevent runs going from the back 12 to the front 11 in the brief.

Embodiments of a method for preventing runs in garments can be utilized on conventional hosiery knitting machines, for example, a 400-needle, Lonati electronic circular knitting machine. In embodiments of the present invention, any knitting machine having sufficient needle selection capability so that sewing marks can be programmed for placement at desired locations may be used.

The present invention includes garments made by the methods described herein. For example, in one embodiment, a garment 10 includes a back portion 12 knit first and a front portion 11 knit after the back portion 12 is knit. Arcuate sewing marks 27 for leg cut-outs 20, 21 are placed at pre-determined locations in the garment blank 10 when it is knitted. Portions of the front and back portions, 11, 12, respectively, can be cut away along the sewing marks 27 to provide leg openings 20, 21, respectively. The back portion leg cutouts 21 are made along an angle 28 substantially parallel to the wales 24 such that a minimum number of wales 24 are cut across, or no wales 24 are cut across. In this manner, runs from the back 12 to the front 11 of the garment 10 are effectively prevented.

In another embodiment of a garment according to the present invention, a tubular underwear garment blank (not shown) knit in one direction includes "run-prevention" stitches 30, such as float 41 or tuck stitches 42, placed in desired courses of the blank along areas where leg cut-outs are to be cut across wales 24. In particular, in an embodiment in which the direction of knitting 25 is from back to front, run-prevention stitches 30 are placed in areas along curved sew lines 27 adjacent where leg cut-outs 20 are to be made in the front portion 11. Such placement of run-prevention stitches 30 in the front portion 11 of the underwear garment prevents runs in the direction of knitting 25 up the front 11 of the finished garment.

Other embodiments of a garment 10 of the present invention include a garment 10 knit in one direction (from front to back or from back to front 25, 26, respectively), an opening 21 cut in a portion of the garment 10, such as a leg or arm opening 21, across a minimum number of wales 24, or across no wales 24, and run-prevention stitches 30 knit in courses 40 at locations downstream and adjacent areas where cut-outs 20 are to be cut across wales 24. In such a garment 10, the combination of cutting across a minimum number of wales 24 for cut-outs 21 substantially parallel to the wales 24 and the placement of run-prevention stitches 30 downstream from the areas for cut-outs 20 across wales 24 provides a garment 10 in which runs are prevented in the direction of knitting 25 at both cut-out areas 20, 21.

Although the present invention has been described with reference to particular embodiments, it should be recognized that these embodiments are merely illustrative of the principles of the present invention. Those of ordinary skill in the art will appreciate that a run prevention method and garment of the present invention may be constructed and implemented in other ways and embodiments. Accordingly, the description herein should not be read as limiting the present invention, as other embodiments also fall within the scope of the present invention.

The invention claimed is:

1. An underwear garment blank, comprising:

yarn knit into wales and courses;

a knit direction from a back portion to a front portion;

a front portion sewing mark for designating a location for making a front portion cut-out across wales in the front portion;

run prevention stitches knit in predetermined courses downstream from the front portion sewing mark; and a back portion sewing mark for designating a location for making a back portion cut-out along an angle substantially parallel to the wales in the back portion, wherein when the front portion cut-out is made along the front portion sewing mark, runs are prevented downstream from the cut-out in the knit direction up the front portion, and wherein when the back portion cut-out is made along the back portion sewing mark, runs are prevented downstream from the back portion cut-out.

2. The underwear garment blank of claim 1, wherein the run prevention stitches comprise float stitches.

3. The underwear garment blank of claim 1, wherein the run prevention stitches comprise tuck stitches.

4. A method for preventing runs in a garment, comprising:

knitting a garment in a direction from an upstream beginning in a back portion to a downstream ending in a front portion;

marking a location for making a cut-out across wales in the front portion;

knitting run prevention stitches in predetermined courses downstream from the cut-out location; and making the cut-out along the marked location, wherein runs are prevented downstream from the cut-out in the direction of knitting up the front portion.

5. The method of claim 4, further comprising marking a location for making another cut-out in the back portion along an angle substantially parallel to the wales, and making the back portion cut-out along the marked location, wherein runs are prevented downstream from the back portion cut-out.

6. The method of claim 4, wherein knitting run prevention stitches comprises knitting float stitches.

7. The method of claim 4, wherein knitting run prevention stitches comprises knitting tuck stitches.

8. The method of claim 4, wherein knitting the garment comprises knitting an underwear garment.

9. The method of claim 4, wherein knitting the garment comprises knitting the front portion and the back portion separately and sewing together the front portion and the back portion along seams.

10. The method of claim 4, wherein marking a location for making the cut-out comprises knitting a sewing mark along the cut-out location.

11. The method of claim 5, wherein marking a location for making the back portion cut-out comprises knitting a sewing mark along the back portion cut-out location.

12. The method of claim 4, wherein knitting the garment further comprises knitting the garment on a circular knitting machine for making pantyhose.

13. A garment blank, comprising:

yarn knit into wales and courses;

a knit direction from an upstream beginning in a back portion to a downstream ending in a front portion;

a location designated for making a cut-out across wales in the front portion; and run prevention stitches knit in predetermined courses downstream from the cut-out location, wherein when the cut-out is made along the designated location, runs are prevented downstream from the cut-out in the knit direction up the front portion.

14. The garment blank of claim 13, further comprising a location designated for making a cut-out in the back portion along an angle substantially parallel to the wales, wherein when the back portion cut-out is made along the designated location, runs are prevented downstream from the back portion cut-out.

15. The garment blank of claim 13, wherein the run prevention stitches comprise float stitches.

16. The garment blank of claim 13, wherein the run prevention stitches comprise tuck stitches.

17. The garment blank of claim 13, wherein the garment blank comprises a lower body garment.

18. The garment blank of claim 13, wherein the garment blank comprises a tubular garment blank.

19. The garment blank of claim 13, wherein the garment blank comprises an underwear garment.

20. The garment blank of claim 19, wherein the underwear garment comprises fine denier yarn.

21. The garment blank of claim 13, wherein the garment blank is knit on a circular knitting machine for making pantyhose.

22. The garment blank of claim 13, wherein the location designated for making the cut-out comprises a sewing mark for designating the cut-out location.

23. The garment blank of claim 14, wherein the location designated for making the back portion cut-out comprises a sewing mark for designating the back portion cut-out location.

* * * * *